United States Patent [19]

Dixon

[11] 4,238,860

[45] Dec. 16, 1980

[54] WATER-PRESSURE, DRAIN-CLEANING DEVICE

[76] Inventor: Russel H. Dixon, 630 Tustin Ave., Newport Beach, Calif. 92663

[21] Appl. No.: 48,057

[22] Filed: Jun. 13, 1979

[51] Int. Cl.[3] ..... E03D 11/00

[52] U.S. Cl. ..... 4/256; 4/257

[58] Field of Search ..... 4/253, 255, 256, 257, 4/286, 295; 15/104.05

[56] References Cited

U.S. PATENT DOCUMENTS

| | | | |
|---|---|---|---|
| 1,998,902 | 4/1935 | Mattich | 4/255 |
| 2,027,661 | 1/1936 | Woodward | 4/256 |
| 2,490,422 | 12/1949 | Denison | 4/256 |
| 3,023,428 | 3/1962 | Otteson | 4/256 |
| 3,064,275 | 11/1962 | Allen | 4/256 |
| 3,537,113 | 11/1970 | Elzner | 4/256 |
| 3,840,033 | 10/1974 | Warsinger | 4/256 |

FOREIGN PATENT DOCUMENTS

| | | | |
|---|---|---|---|
| 137871 | 10/1952 | Sweden | 4/256 |

*Primary Examiner*—Richard R. Stearns
*Attorney, Agent, or Firm*—Francis X. LoJacono

[57] ABSTRACT

A drain-cleaning device adapted to unclog drains and pipes having various sized openings and toilet bowls having various outlet configurations, the device comprising an inverted flexible and resilient cup defined by a dome-shaped inner wall surface and an outer annular wall surface which includes a plurality of contiguous annular rim members, each being formed with a predetermined diameter to fit a corresponding drain or pipe opening when placed thereover, the cup being adapted to receive water therethrough under pressure, and the device further including a bulbous plug fitting adapted to be secured to the central opening disposed in the cup member so as to protrude outwardly therefrom in order to be directly received in a corresponding opening, whereby the opening can be sealed by the plunger as water passes therethrough.

3 Claims, 7 Drawing Figures

44
46
42
40
48
49
30
32
26
28
24
16
10
35
20
12
22
52
50
54
43

WATER-PRESSURE, DRAIN-CLEANING DEVICE

BACKGROUND OF THE INVENTION

1. Field of the Invention

This invention relates generally to a drain-cleaning device, and more particularly to a drain-cleaning device adapted to be provided with water pressure, whereby the device can be used with several types and configurations of drains and pipe openings.

2. Description of the Prior Art

As is well known in the art, various problems and difficulties are encountered in providing suitable drain-cleaning means that are capable of accommodating various sized openings and also provide high water pressure during the cleaning phase.

Several types of known drain-cleaning devices are in use but most of these known devices have features that restrict their use or application, particularly where a clogged drain requires direct water pressure to engage the blocked area of the pipe or drain.

As examples of various known devices which have established limitations over the present invention, the following United States patents should be considered:

U.S. Pat. No. 3,064,275 to Allen which is designed for use with sink drains and is limited to small drain openings.

U.S. Pat. No. 3,537,113 to Elzner which is a typical plunger cup adapted with a tubular handle to allow water to flow therethrough in a single direction relative to the cup.

U.S. Pat. No. 994,442, U.S. Pat. No. 2,011,525 and U.S. Pat. No. 2,027,661 which also provide water pressure, but with limited applications.

SUMMARY AND OBJECTS OF THE INVENTION

The present invention has for an important object a provision wherein the cup member is designed to be used from either the upper or bottom wall; that is, under certain requirements the dome formed in the bottom of the cup will accommodate several sizes of drain openings when just a plunging action is necessary to loosen a clogged pipe; while the upper wall is employed to cover any given size opening that corresponds to the annular rim member, whereby water is passed through a centrally disposed hole adapted to receive a hose attached thereto.

It is also an object to provide a means whereby a hose can be attached to either side of the opening as may be required for a particular problem.

It is another object of the present invention to include a bulbous or spheroidal member which defines a plug fitting that is removably mounted to the central opening of the cup member, whereby the bulbous configuration is adapted to be received in large irregular shaped openings such as found in toilet bowls and the like.

It is a further object of the invention to provide a device of this character wherein the bulbous member can be expanded by internal water pressure, allowing the outer walls to seal within a given opening whereby pressure is established between the expanded bulb member and the clogged or blocked portion of the drain.

It is still another object of the invention to provide a drain-cleaning device of this type that is relatively inexpensive to manufacture, and that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
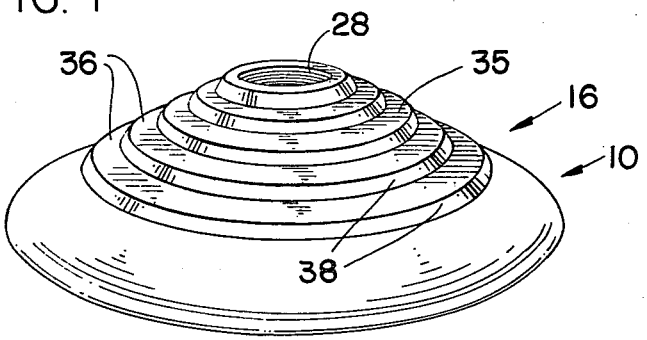
FIG. 1 is a perspective view of the present invention, illustrating the plurality of annular rim members formed on the upper wall thereof.
Figure 2:
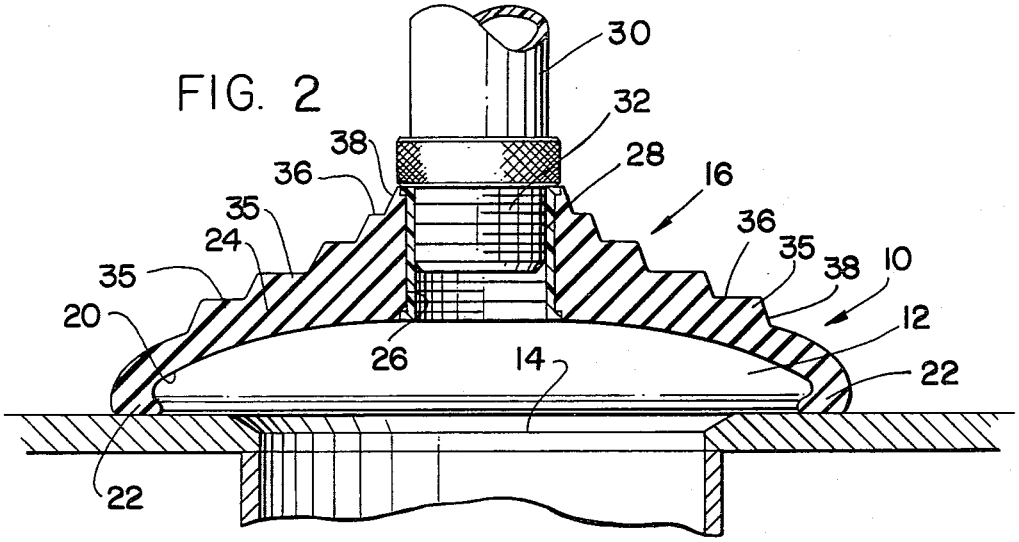
FIG. 2 is a cross-sectional view of the cup member having a hose attached thereto and positioned over a drain outlet.
Figure 3:
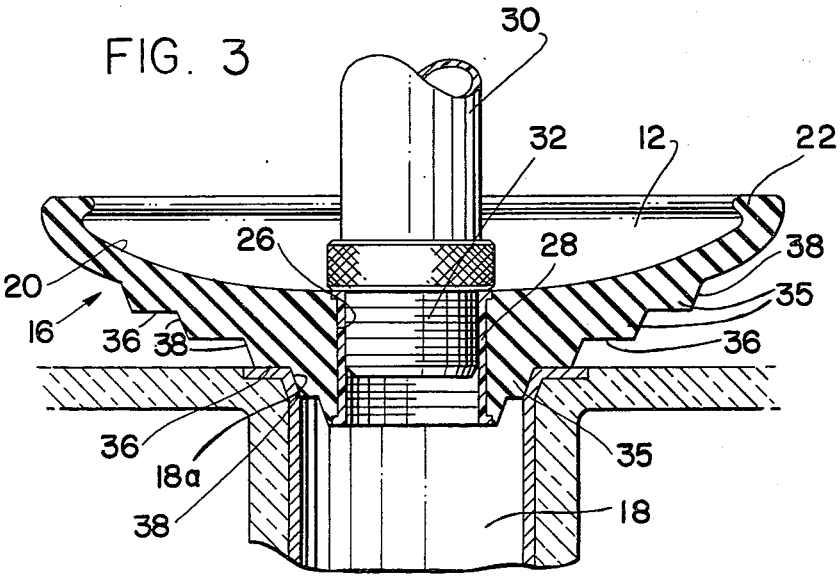
FIG. 3 is another cross-section of the cup member that is in a reversed position, whereby a given size rim member is received in a corresponding size drain opening with the hose attached to the inner wall of the cup.

Referring now to the drawings and more particularly to FIGS. 1, 2 and 3, there is shown an improved drain-cleaning device having a wide range of applications wherein the device comprises a plunger-like cup member, generally indicated at 10, adapted to be used in a typical inverted position—that is, the cup-like dome chamber 12 is arranged over an outlet drain such as 14 in FIG. 2. Or, it can be employed with cup chamber 12 facing upwardly and the outer ringed surface, designated generally at 16, engaging the opening of a drain 18, as illustrated in FIG. 3.

Accordingly, the cup 10 includes cup-like chamber 12 which is provided with an inner-domed arcuate surface 20 terminating along an annular, lower, enlarged lip member 22 which acts as an annular seal between chamber 12 and the opening of drain 14. It should be noted at this time that the main cup-like body 24 is formed from a flexible, resilient material, such as rubber or the like, wherein the central body portion is provided with a central bore 26 in which is affixed a threaded sleeve 28. Sleeve 28 is adapted to threadably receive the end of any suitable hose, particularly the flexible garden-type water hose, indicated at 30, having a typical threaded connector 32.

As illustrated in FIG. 2, hose 30 is secured at the outer surface of the cup's main body, whereby the cup is used in the inverted position. However, in FIG. 3, hose 30 is secured at the inner domed surface 20—whereby the cup chamber 12 is facing upwardly, and the outer ringed surface 16 is inverted and engaging drain 18. Thus, it can be seen that water can be forced into either drain 14 or 18, the cup member 10 being seated and sealed about each opening.

When the cup member is inverted as seen in FIG. 2, the device is capable of being operated as a flexible plunger as well as having water passing therethrough. However, when used as shown in FIG. 3, surface 16 is so arranged as to be provided with a plurality of annular rim members 35. Each rim member is provided with various sized diameters to accommodate the corresponding drain or pipe openings. Each annular rim member is defined by a flat horizontal surface 36 and an inclined mating surface 38, thus establishing a positive annular seal around the drain opening as indicated at 18*a*. This positive seal between the rim member 35 and the opening 18*a* will allow the pressure of the incoming water from hose 30 to create a force within the pipe so as to unclog the blocked point therein.

Figures 4, 5, 6, 7:
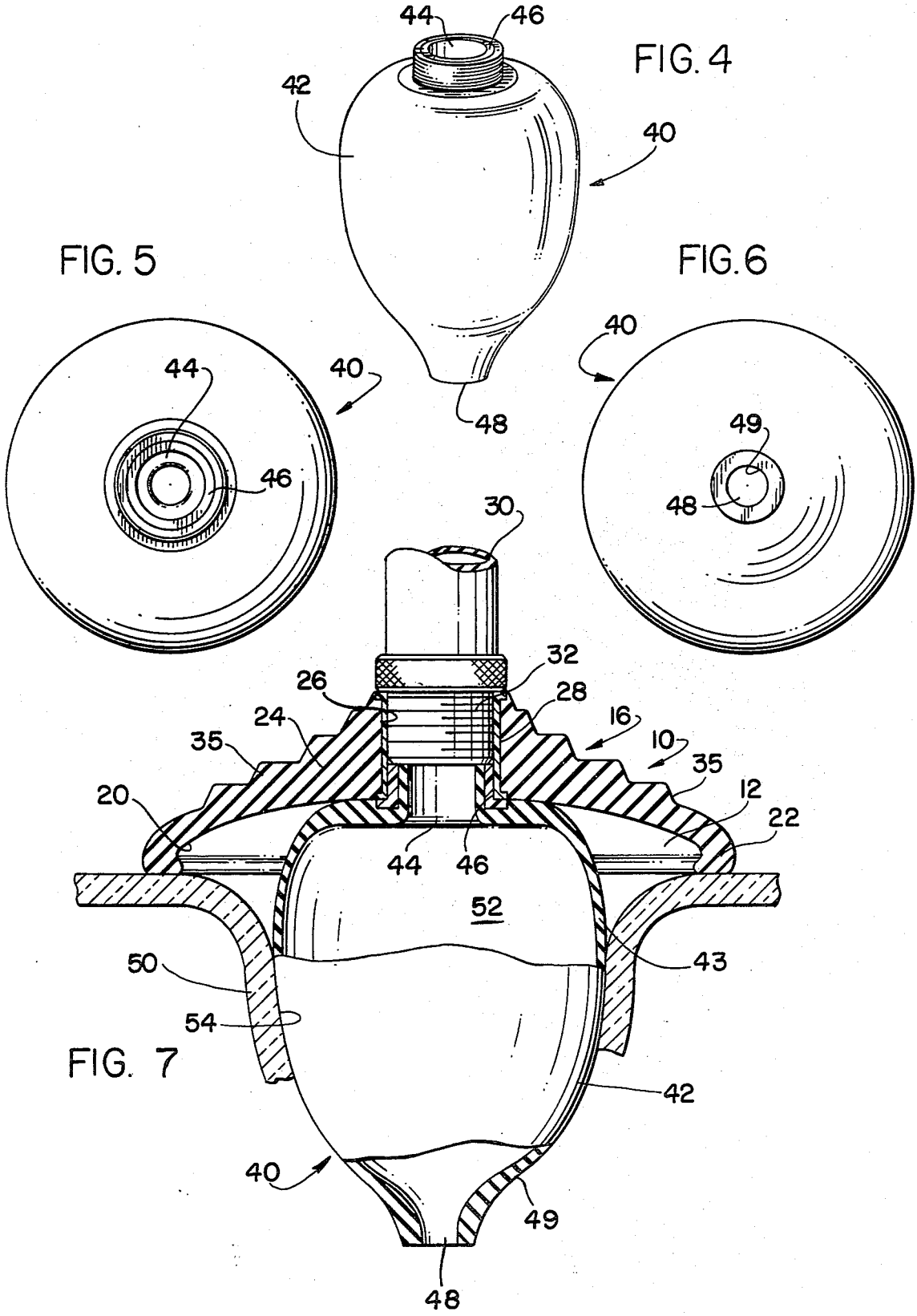
FIG. 4 is a perspective view of the bulbous plunger member.
FIG. 5 is a top-plan view thereof.
FIG. 6 is a bottom-plan view thereof.
FIG. 7 is an enlarged, cross-sectional view with the plunger attached to the cup member and positioned in a drain outlet.

Referring now to FIGS. 4 through 7, there is shown an adapter, designated at 40, which will be also referred to as a plug fitting. Said plug fitting is formed from a resilient rubber like material having a bulbous and somewhat spherical configuration. This fitting is designed to be mounted to cup member 10, as seen in FIG. 7, wherein the adapter comprises a bulbous housing 42 having a somewhat thin spherical wall 43, an inlet port 44 being provided with a threaded collar 46 which is adapted to be received in sleeve 28 of cup 10. The lower end of body or housing 43 includes an outlet port 48 having an enlarged wall section 49 to cause a slight back pressure during water flow therethrough. This adapter is designed for various types and configurations of openings found in toilet bowls, as indicated at 50. Thus, as water pressure is increased within adapter chamber 52, the annular wall 43 will expand within toilet opening 54, thereby providing a positive seal to allow water pressure to build within the toilet's outlet pipe, and to thereby force open the blocked area.

It should be further understood, however, that the adapter can be employed without the use of the cup member 10, as long as suitable coupling means are provided to attach hose 30 thereto.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form or uses mentioned, except as defined in the accompanying claims.

I claim:

1. A water-pressure, drain-cleaning device in combination with a water hose comprising:

a cup-like body member having an outer ringed wall and an inner arcuate domed wall;

an inner cup chamber defined by said inner arcuate domed wall and an annular lip member formed at the terminating annular edge of said inner arcuate wall;

said outer ringed wall defined by a plurality of annular rim members arranged contiguously to each other, each having a different size diameter defining sealing means when disposed over a corresponding opening of a drain;

wherein each of said annular rim members includes a flat sealing surface and an inclined sealing surface for positive sealing engagement with said drain opening;

said cup-like body including a central bore communicating with said cup chamber, said bore having a threaded sleeve member affixed therein to removably receive said water hose therein from either side of said sleeve member; and a removable plug fitting having an inlet port and an outlet port, said inlet port being adapted to be secured to said threaded sleeve member of said cup body, said plug fitting being formed from a resilient material so as to expand under water pressure, whereby said plug fitting conforms to the configuration of said adjacent drain opening.

2. A water-pressure, drain-cleaning device as recited in claim 1, wherein said plug fitting comprises a spherical bulbous housing having a thin annular wall member, and wherein said outlet port is formed having an enlarged wall area and a diameter less than the diameter of said inlet port.

3. A water-pressure, drain-cleaning device as recited in claim 2, wherein said inlet port is provided with a threaded collar to be received in said threaded sleeve of said cup body.

* * * * *